US009663980B2

(12) United States Patent
Bakalar

(10) Patent No.: US 9,663,980 B2
(45) Date of Patent: May 30, 2017

(54) MOTORIZED WINDOW BLIND

(71) Applicant: Melvin N. Bakalar, West Bloomfield, MI (US)

(72) Inventor: Melvin N. Bakalar, West Bloomfield, MI (US)

(73) Assignee: Melvin N. Bakalar, West Bloomfield, MI (US)

( * ) Notice: Subject to any disclaimer, the term of this patent is extended or adjusted under 35 U.S.C. 154(b) by 0 days.

(21) Appl. No.: 14/858,630

(22) Filed: Sep. 18, 2015

(65) Prior Publication Data

US 2015/0376939 A1 Dec. 31, 2015

(51) Int. Cl.

| | |
|---|---|
| ***E05D 15/06*** | (2006.01) |
| ***E05D 15/56*** | (2006.01) |
| ***E05F 17/00*** | (2006.01) |
| ***E06B 7/082*** | (2006.01) |
| ***E06B 9/04*** | (2006.01) |
| *E05F 15/652* | (2015.01) |

(52) U.S. Cl.

CPC ..... *E05D 15/0604* (2013.01); *E05D 15/56* (2013.01); *E05F 17/004* (2013.01); *E06B 7/082* (2013.01); *E06B 9/04* (2013.01); *E05F 15/652* (2015.01); *E05Y 2201/406* (2013.01); *E05Y 2900/146* (2013.01)

(58) Field of Classification Search

CPC ..... E05D 15/0604
USPC ..... 49/61, 63, 142, 125, 127, 128, 130
See application file for complete search history.

(56) References Cited

U.S. PATENT DOCUMENTS

| | | | | | |
|---|---|---|---|---|---|
| 377,771 | A * | 2/1888 | Phillips | E06B 9/0638 | 160/115 |
| 2,196,591 | A * | 4/1940 | Kramer | E06B 3/4654 | 160/114 |
| 3,577,679 | A * | 5/1971 | Petterborg | E05D 15/0608 | 49/127 |
| 3,744,184 | A * | 7/1973 | Niemi | B28B 7/243 | 160/201 |
| 3,816,964 | A * | 6/1974 | Catalano | E05D 15/0608 | 49/127 |
| 4,669,219 | A * | 6/1987 | Tomida | E05D 15/1013 | 49/130 |
| 5,287,653 | A * | 2/1994 | Young | E05D 15/1065 | 312/295 |
| 5,347,757 | A * | 9/1994 | Losito | B61D 19/009 | 49/130 |
| 5,613,323 | A * | 3/1997 | Buening | B60J 1/16 | 49/130 |

(Continued)

*Primary Examiner* — Katherine Mitchell
*Assistant Examiner* — Catherine A Kelly

(57) ABSTRACT

A motorized window blind includes a slotted motorized track member mounted to a vertical wall structure of a building and extending across the top of an opening in the wall. It also includes at least two panels mounted to the track and covering the wall opening while being in a position where the panels are parallel and coplanar with one another. The motorized track member has at least one motorized actuation system enabling one panel to move forward away from the opening thereby freeing the track for the second panel to laterally slide behind the first panel. The panels become stacked in a parallel superimposed position in relation with one another. In the stacked position, the panels cover a portion of one end of the opening while completely uncovering a potion at the other end of the opening.

20 Claims, 2 Drawing Sheets

(56) References Cited

U.S. PATENT DOCUMENTS 5,826,377 A 10/1998 Simson
5,930,953 A * 8/1999 Estfeller ..... E05D 15/0613 49/127
5,996,282 A 12/1999 Giovannetti
6,082,053 A * 7/2000 Bischof ..... E05D 15/0604 49/221
6,286,258 B1 9/2001 Bischof
6,385,910 B1 * 5/2002 Smink ..... B60J 5/062 49/120
6,460,293 B1 * 10/2002 Bischof ..... E05D 15/0608 160/221
6,662,502 B2 * 12/2003 Janutta ..... E05D 15/0608 49/127
6,691,462 B2 * 2/2004 Oestermann ..... E05B 65/0876 292/36
6,860,064 B2 * 3/2005 Bakalar ..... E05D 15/0613 160/126
7,175,226 B1 * 2/2007 Queener ..... B60J 1/17 296/146.16
7,546,866 B2 6/2009 Strand et al.
7,647,728 B2 * 1/2010 Bortoluzzi ..... E05D 15/1042 49/209
7,861,475 B2 1/2011 Sprague
8,096,629 B2 * 1/2012 Halfon ..... E05D 15/0652 312/319.7
8,113,552 B2 2/2012 Ritt
8,113,607 B2 * 2/2012 Slager ..... E05B 65/0882 292/137
8,245,445 B2 * 8/2012 Palacios ..... E05D 13/1253 49/127
8,627,604 B2 * 1/2014 Seymour ..... E05D 15/58 49/125
2007/0245633 A1 * 10/2007 Zab ..... E06B 7/08 49/409
2008/0302016 A1 * 12/2008 Halfon ..... E05D 15/0652 49/130
2010/0199563 A1 * 8/2010 Bortoluzzi ..... E05D 15/1042 49/128
2012/0111509 A1 5/2012 Mullet et al.

* cited by examiner

MOTORIZED WINDOW BLIND

FIELD OF THE INVENTION

The invention relates to a motorized covering arrangement that enables automatic covering and uncovering of portions of the wall opening such as defined by a window, doorway and the like. In particular, the invention is related to a motorized window blind having at least two panels slidable between a position where the panels are coplanar with one another and in superimposed covering relation with respect to the wall opening, and another position wherein the panels are in parallel superimposed relation with one another and with a portion of the wall opening whereby substantially uncovering the other portion of the wall opening.

BACKGROUND

Windows, patio doors, partitioning walls, and selectively positionable covering arrangements of the type wherein a first panel, such as a door, or a window, or a panel, or a blind is moved from a first to a second position relative to a portion of an opening whereby opening or closing a window opening, doorway, portion of a room and the like opening defined in the mounting frame of the covering panels are known.

Depending upon the application, the covering panels are generally rectangular, and the opposite horizontal or vertical end portions of the framed covering panels are mounted in a track of a frame or sash. In operation, at least one of the covering panels tilts and/or slides relative to its mounting.

Illustrative covering arrangements are shown in U.S. Pat. No. 7,546,866 B2, U.S. Pat. No. 2012/0111509 A1., U.S. Pat. No. 7,861,475 B2, U.S. Pat. No. 6,286,258 B1, U.S. Pat. No. 7,647,728 B2, U.S. Pat. No. 5,996,282, E.P. Pat. No. 1507057, U.S. Pat. No. 5,826,377, U.S. Pat. No. 6,860,064 B2, and U.S. Pat. No. 8,113,552.

While suitable for their intended purposes, there is an ongoing need for improvements in enhancing these covering arrangements.

In particular, some of these covering arrangements are comprised of two panels that manually slide horizontally between closed and and/or open positions. Typically, the user desires to cover or uncover the wall openings, so as to permit light to enter, block off sunlight, establish privacy, permit or restrict entrance of air, or enter or leave an area.

Accordingly, there is a need for a motorized, remote-controllable window blind fixture that would enable a user to automatically position blinds in either coplanar side-by-side relation with one another in superimposed relation with respect to a wall opening, whereby the blinds substantially block the opening, and also to automatically move at least one of the blinds into parallel stacked relation with the other blind and a portion of the wall opening, whereby to substantially open the other portion of the wall opening in order to provide full and unobstructed access to it.

Desirably, the fixture should hold 2 or 2½ inch horizontal wood blinds and contain remote-controlled motorized tracks allowing one blind to move forward from the coplanar position with the other blind, and the other blind to laterally move behind the first to form a parallel superimposed positioning in relation to one another in order to enable complete and effortless uncovering either one or the other side of the wall opening. The blinds can also be opened or closed in any position in relation to the wall opening, and can be raised. Additionally, such a covering arrangement would be compact and mountable in close proximity to the wall opening. It should be simple is operation, inexpensive, and use standard and/or conventional components that are readily available in the marketplace.

SUMMARY

It is an object of the present invention to overcome deficiencies in window and door covering arrangements currently available in the market by providing a motorized covering arrangement for an opening in a wall structure of a building where, by means of a remote control, at least a pair of covering panels automatically move from a coplanar side-by side relation with respect to one another substantially covering the opening into a parallel stacked relation with respect to each other thereby entirely uncovering one of the portions of the opening.

According to this invention, disclosed is a rectangular opening having a width and a height defined in a wall structure of a building, such as a doorway or window, having portions of the opening closed by door or window members disposed in generally coplanar side-by-side relation, and a covering arrangement for covering and uncovering the door members of the opening. One of the door or window members is slidable relative to the other in order to move between first and second positions so that the wall opening is respectively closed and, at least in part, open thereby preventing or allowing passage through the opening.

The motorized window blind includes at least two covering panels, the covering panels being of sufficient lateral width and vertical height to substantially cover the door or window members of the opening and being able to, by means of a motorized actuation system, automatically position themselves in either coplanar side-by-side relation with one another and superimposed relation with the respective door or window members of the opening, or move into parallel stacked relation with one another and superimposed relation with one of the portions of the opening.

For the purpose of support of the covering panels, the motorized window blind further includes an elongated track located horizontally above the opening and extending across the width of the opening.

The elongated track has at least one motorized actuation system used to automatically operate the panels from a position where the panels are in coplanar side-by-side relationship with respect to each other to a position where the panels are stacked in parallel planar relationship with respect to each other.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

The following description is of one presently contemplated mode of carrying out the invention of a motorized device for selectively covering an opening in a wall structure of a building, capable of incorporation into door or window coverings, such as blinds or wood slats. The motorized window blind invention is configured for substantially covering and uncovering entire portions of the doors or windows defined in a wall structure of a building.

Figure 1:
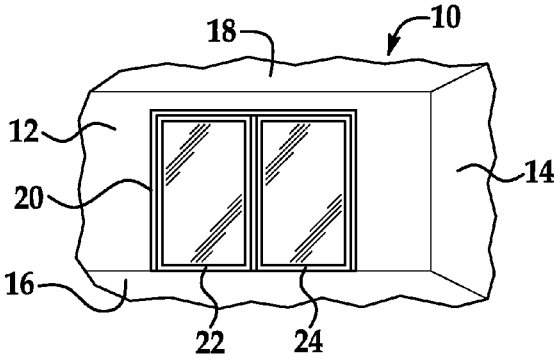
FIG. 1 is a perspective environmental front elevation view of a conventional door or window frame of the type including two laterally slidable generally coplanar doors (or windows) that are to be covered and uncovered by a motorized covering arrangement according to this invention.

In the illustration shown in FIG. 1, there is shown a room 10 of a building, house, or other like structure, the room including vertically extending walls 12 and 14, and a floor 16 vertically separated from a ceiling 18. A generally rectangular shaped door frame 20 is mounted in and forms an opening or door way in the wall 12.

Figure 2:
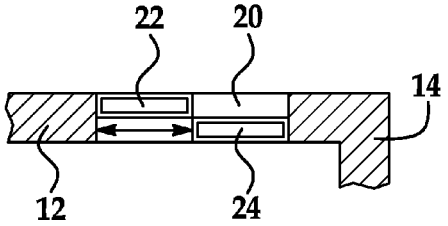
FIG. 2 is a horizontal cross-sectional view of wall 12 of FIG. 1.

FIG. 2, included for the purposes of describing the environment of the invention, shows a horizontal cross-sectional view of vertical wall 12 encasing the door frame 20 which includes conventional track members for support of a pair of closure members 22 and 24 in generally side-by-side coplanar relationship for lateral sliding movement between open and closed positions. As shown in FIG. 2, the closure member 24 is capable of sliding in the direction shown by the arrow, while closure member 22 is generally stationary in a fixed position. The door frame 20 is conventional and well known in the art and will not be described to any significant degree. It is to be understood that the doorway could also be a window or like closable opening in a wall.

Figure 3:
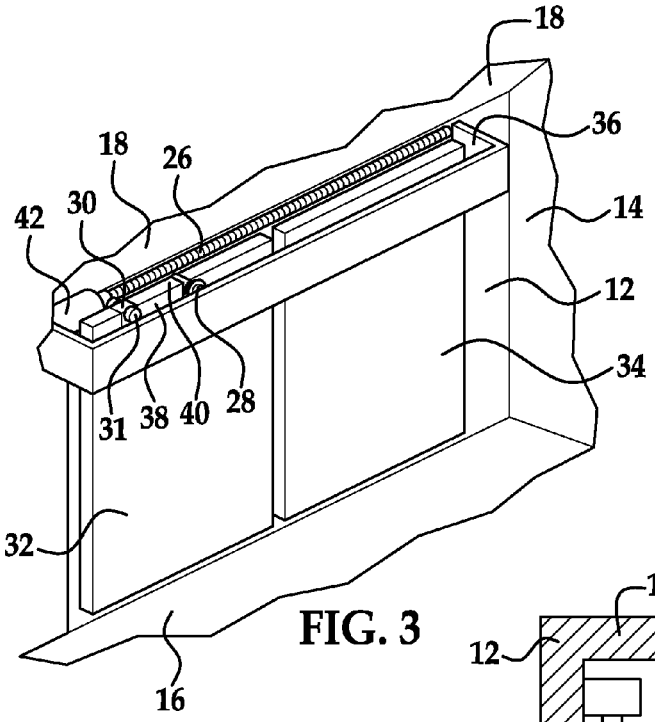
FIG. 3 is a perspective view of motorized covering arrangement for covering the lateral sliding doors or windows of FIG. 1.

FIG. 3 shows a perspective view of a motorized covering arrangement having an elongated primary track 36 positioned above and extending across the doorframe 20 defined in the wall 12. The elongated track supports covering panels 32 and 34 substantially covering the doorframe 20, where the covering panels 32 and 34 are in coplanar side-by-side relation with one another and superimposed relation with the doorframe 20 of the opening. The elongated primary track 36 further includes a second rod 26 extending over the distance of the elongated primary track 36 while being directly connected to the second motor 42. The elongated primary track 36 also includes a secondary track 38 positioned perpendicular to the primary track 36. The secondary track 38 is shown to have a first rod 28 which is positioned below and perpendicular to the second rod 26 and indirectly connected to a first motor 40. The secondary track 38 further includes a guide 30 located on both sides and parallel to the first rod. The guide 30 as well as the first rod 28 have rollers 31 that are used to secure and support covering panel 32 in its perpendicular movement away from the doorframe 20 thus enabling covering panel 34 to laterally slide across the doorframe 20 and behind the covering panel 32.

Figure 4A:
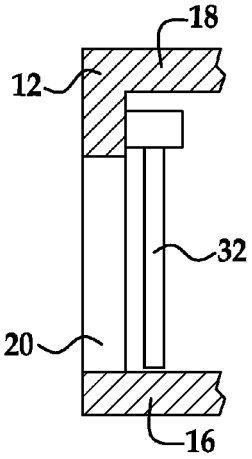
FIG. 4*a* is a vertical cross-sectional view of wall 12 of FIG. 1, where the covering panels are in coplanar side-by-side position in relation to each other.
Figure 4B:
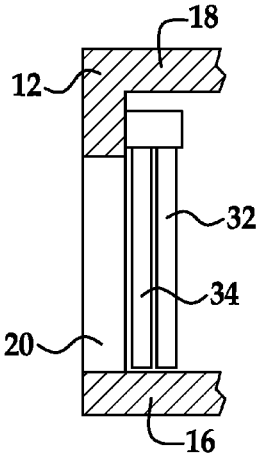
FIG. 4*b* is a vertical cross-sectional view of wall 12 of FIG. 1, where the covering panels are in parallel stacked position in relation to each other.

FIGS. 4A and 4B, included for the purpose of describing the environment of the invention, show side views of a generally rectangular room of a building with a vertical cross-sectional view of the vertical wall 12 encasing the door frame 20. The view also displays the cross-section of the floor 16, and the ceiling 18. As shown in FIG. 4A, the covering panels 32 and 34 are in a first configuration, where the first covering panel 32 is flush with the other covering panel 34 while being in coplanar side-by-side relationship with one another. The covering panels in this position are in superimposed relationship with the wall opening 20, thus substantially covering it. As shown in FIG. 4B, the covering panels 32 and 34 are in a second configuration, where the first covering panel 32 and the second covering panel 34 are superimposed stacked in substantially parallel relationship with each other. The covering panels in this position are in superimposed relationship with only a portion of the wall opening 22, thus substantially uncovering the other portion of the wall opening 24.

Figure 5:
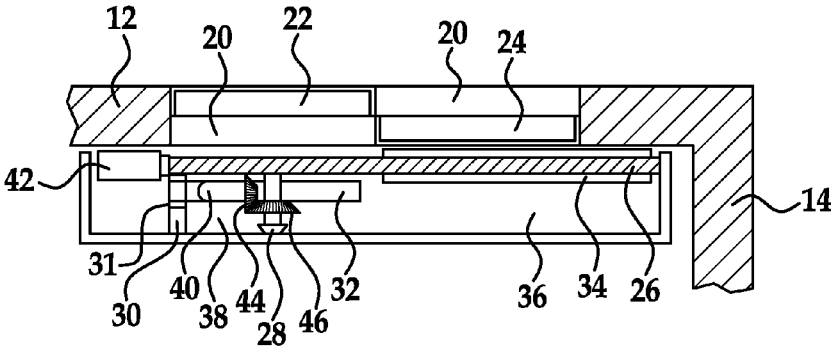
FIG. 5 is a horizontal cross-sectional view of wall 12 of FIG. 1 together with the top view of the motorized covering arrangement vertically mounted to wall 12 above the wall opening according to this invention.

FIG. 5 displays a top view of both a horizontal cross-sectional view of vertical wall 12 and the motorized covering arrangement positioned above and extending across the doorframe 20 defined in the wall 12. The vertical wall 12 encases the door frame 20 which includes conventional track members for support of a pair of closure members 22 and 24 in generally side-by-side coplanar relationship for lateral sliding movement between open and closed positions. The motorized covering arrangement, as shown in the top view, includes a primary track 36 having opposite ends and extending across the wall opening 20, and a secondary track 38 having opposite ends and extending across a portion of the opening 22. The primary track 36 includes a second rod 26 extending across the length of the primary track 36 and being connected to the second panel 34 by the use of the two nylon "H" blocks with threaded inserts. The second rod 26 is directly connected to a second motor 42 by the use of a steel connector and is used for lateral driving movement of the second panel 34 across the wall opening 20 in response to rotation of the second motor 42. The secondary track 38 includes a first rod 28 extending perpendicular to the second rod 26 and being connected to the first panel 32 by the use of the rollers 31. The rollers 31 are supported and traveling along the guide 30 extending on both sides and parallel to the first rod 28. The first rod 28 is indirectly connected to a first motor 40 and is used for perpendicular driving movement of the first panel 32 away from the portion of the opening 22, thus enabling the second panel 34 to slide in parallel behind it. The first rod 28 is connected to the first motor 40 by the use of the two bevel gears; a first bevel gear 44 and a second bevel gear 46. The first motor 40 is positioned perpendicular to the first rod 26. The first bevel gear 44 is positioned parallel to the first rod 28 and is directly connected to the first motor 40 through the center of its radius. The second gear 46 is positioned perpendicularly to the first bevel gear 44 and is directly connected to the first rod 28 by having the first rod 28 inserted through the center of its radius. The bevel gears 44 and 46, while in perpendicular configuration with respect to each other, are mutually engaged, where the first bevel gear 44 is driven in response to rotation of the first motor 40, and the second bevel gear 46 along with the first rod 28 are driven in response to rotation of the first bevel gear 44.

Figure 6:
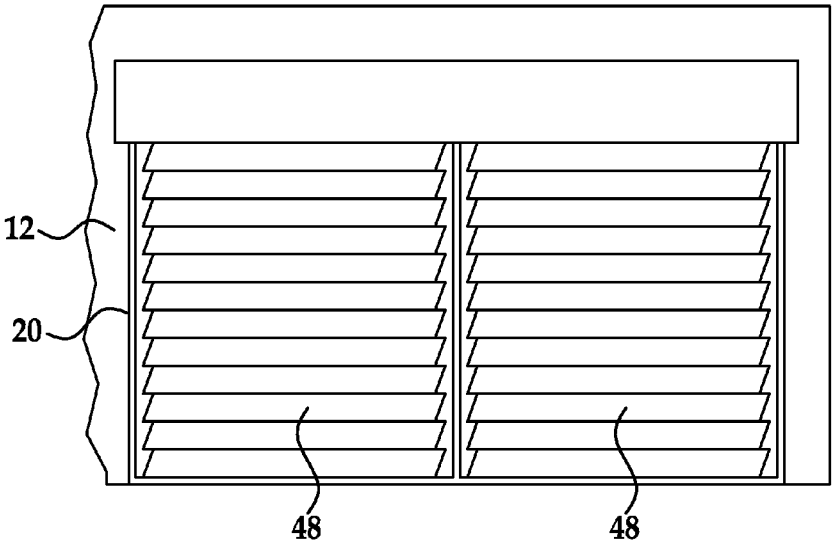
FIG. 6 is a perspective environmental front elevation view of a 2-panel wooden slat blind.

In the illustration shown in FIG. 6, there is shown a perspective elevation view of a motorized covering arrangement having a pair of wood slats 48 in place of a first panel 32 and a second panel 34 as it was previously depicted. The pair of wood slats 48 is disposed in a first configuration where the slats are in a coplanar side-by-side relation with respect to each other while superimposing and substantially covering an opening in a wall 20 defined in a vertically extending wall 12.

Figure 7A:
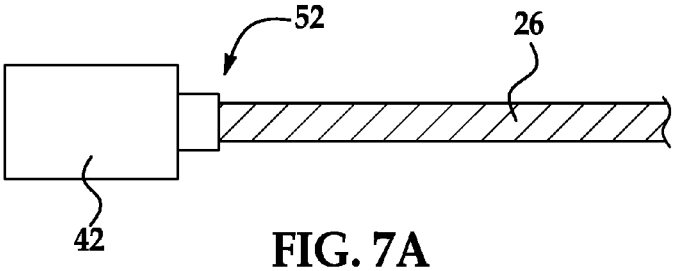
FIG. 7*a* is depiction of a second motorized actuation system according to the invention.
Figure 7B:
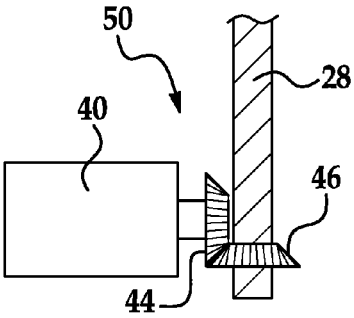
FIG. 7*b* is a drawing of the first motorized actuation system according to the invention.

FIGS. 7A and 7B provide a more detailed view of the two motorized actuation systems of the invention. FIG. 7B shows a first motorized actuation system 50 which includes a first motor 40, a first rod 28 indirectly connected to the first motor 40 through an engagement of a pair of bevel gears, a first bevel gear 44, and a second bevel gear 46, the gears being engaged by a perpendicular configuration. The first rod 28 is indirectly connected to a first motor 40 FIG. 7A shows a second motorized actuation system 52 which includes a second motor 42 and a second rod 26 directly connected to the motor 42 by the use of a steel connector.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for selectively covering an opening having a width and a height defined in a wall structure of a building (10), the device comprising:

a first panel (32) operable to cover a portion of the width of the opening (22) and extending over the height of the opening;

a second panel (34) operable to cover another portion of the opening (24) and extending over the height of the opening;

a first elongated track located horizontally adjacent to the opening (20) and extending across the width of the opening; and at least one motorized actuation system arranged for moving the first panel (32) and the second (34) panel from a first configuration, wherein the first and second panels are substantially aligned coplanar with respect to one another and substantially cover the width of the opening (20), to a second configuration, wherein the first (32) and second (32) panels are superimposed stacked in substantially parallel planar relationship with respect to each other providing an unobstructed passage through at least a portion of the width of the opening (20);

wherein the first elongated track (36) supports longitudinal movement of the second panel (34) only along a primary path of travel extending parallel to the width of the opening (20); and a second track (38) is positioned substantially perpendicular to the first elongated track (36) and supports movement of the first panel (32) only along a linear secondary path of travel extending substantially perpendicular to the first elongated track (36).

2. The device of claim 1, wherein the at least one motorized actuation system further comprises:

a first motorized actuation system (50); and a second motorized actuation system (52).

3. The device of claim 2, wherein the first motorized actuation system (50) further comprises:

a first motor (40) for moving the first panel (32);

a first bevel gear (44) connected for rotation driven by the first motor (40);

a second bevel gear (46) to be driven in response to rotation of the first bevel gear (44) driven by the first motor (40);

a first rod (28) connected to the second bevel gear (46) to be driven in rotation by rotation of the first motor (40) through the first (44) and second (46) bevel gears, the first rod (28) connected to the first panel (32) for driving movement of the first panel (32) in response to rotation of the first rod (28).

4. The device of claim 3, wherein an axis of rotation of the first motor (40) is positioned perpendicular to an axis of rotation of the first rod (28).

5. The device of claim 2, wherein the second motorized actuation system (52) comprises:

a second motor (42) for moving the second panel (34); and a second rod (26) connected to the second panel (34) for driving movement of the second panel (34) in response to rotation of the second rod (26) by the second motor (42).

6. The device of claim 5, wherein an axis of rotation of the second motor (42) is positioned substantially parallel longitudinally with respect to an axis of rotation of the second rod (26).

7. The device of claim 1, wherein the first elongated track and the second track, are positioned above the opening.

8. The device of claim 1, wherein the first panel and the second panel are slat blinds.

9. A device for selectively covering an opening (20) having a width and a height defined through a wall structure of a building, the device comprising:

a first panel (32) operable to cover a portion of the width of the opening (22) and extending over the height of the opening;

a second panel (34) operable to cover another portion of the width of the opening (24) and extending over the height of the opening;

a primary elongated track (36) located horizontally adjacent to the opening (20) and extending across the width of the opening, the primary elongated track supporting the first (32) and second (34) panels for movement relative to the opening (20) between a closed position blocking passage through the opening (20) and an opened position allowing passage through at least a portion of the opening (20); and a first motorized actuation system (50) and a second motorized actuation system (52) for moving the first (32) and second (34) panels from the closed position, wherein the first (32) and second (34) panels are substantially aligned coplanar with respect to each other and substantially cover the width of the opening (20), to the open position, wherein the first (32) and second (34) panels are superimposed stacked in substantially parallel relationship with respect to each other providing an unobstructed passage through at least a portion of the opening (20);

wherein the primary elongated track (36) supports only longitudinal movement of the second panel (34) along a primary path of travel extending parallel to the width of the opening (20); and a secondary track (38) is positioned substantially perpendicular to the primary elongated track (36) and supports only movement of the first panel (32) along a linear secondary path of travel extending substantially perpendicular to the primary elongated track (36).

10. The device of claim 9, wherein the second motorized actuation system (52) further comprises:

a motor (42) for moving the second panel (34) along the primary elongated track (36); and a rod (26) connected to the second panel (34) for driving movement of the second panel (34) in response to rotation of the rod (26).

11. The device of claim 10, wherein the motor (42) is directly connected to the rod (26).

12. The device of claim 10, wherein the motor (42) is positioned parallel longitudinally in relation to the rod (26) and the primary elongated track (36).

13. The device of claim 9, wherein the first motorized actuation system (50) further comprises:

a motor (40) for moving the first panel (32) along the secondary track (38);

a first bevel gear (44) connected for rotation driven by the motor (40);

a second bevel gear (46) to be driven in response to rotation of the first bevel gear (44) driven by the motor (40);

a rod (28) connected to the second bevel gear (46) to be driven in rotation by rotation of the motor (40) through the first (44) and second (46) bevel gears, the rod (28) connected to the first panel (32) for driving movement of the first panel (32) in response to rotation of the rod (28).

14. The device of claim 13, wherein the motor (40) is positioned with an axis of rotation extending perpendicularly in relation to a rotation axis of the rod (28) and a longitudinal axis of the secondary track (38).

15. The device of claim 13, wherein the secondary track (38) further comprises a guide (30) to direct movement of the first panel (32) in a direction generally perpendicularly away from the primary elongated track (36).

16. The device of claim 15, wherein the guide (30) is positioned parallel to the first rod (28) and the secondary track (38).

17. The device of claim 9, wherein the first panel (32) is secured to a guide (30) to direct movement of the first panel (32) in a direction generally perpendicularly away from the primary elongated track (36) by rollers (31).

18. The device of claim 9, wherein the primary elongated track and the secondary track are positioned above the opening.

19. The device of claim 9, wherein the first panel and the second panel are slat blinds.

20. A window covering, comprising:

a first panel configured to translate only in a lateral direction, the lateral direction being substantially parallel to a plane of an opening, and the first panel configured to cover a first portion of the opening in a closed position;

a second panel configured to translate only in a second direction, the second direction being substantially perpendicular to the lateral direction, the second panel configured to cover a second portion of the opening;

an actuation system configured to move the panels to an open position, wherein the second panel is translated in the second direction, and the first panel is translated in the lateral direction, such that the first and second panels are superimposed, and the first portion of the opening is uncovered.

* * * * *